United States Patent [19]

Levin et al.

[11] 3,968,529

[45] July 13, 1976

[54] PILLOW STRUCTURE

[76] Inventors: Martin Levin; Selene Levin, both of 333 W. 56th St., New York, N.Y. 10019

[22] Filed: Dec. 17, 1974

[21] Appl. No.: 533,512

[52] U.S. Cl. ..... 5/338; 5/357; 5/341

[51] Int. Cl.[2] ..... A47G 9/00; A47C 27/00

[58] Field of Search ..... 5/337–338, 5/351, 357

[56] References Cited

UNITED STATES PATENTS

| | | | |
|---|---|---|---|
| 395,043 | 12/1888 | Doremus | 5/341 |
| 2,577,595 | 12/1951 | Tobias | 5/341 |
| 2,765,480 | 10/1956 | Mueller | 5/341 |
| 3,469,882 | 9/1969 | Larsen | 5/357 |
| 3,736,023 | 5/1973 | Lyons | 5/357 |
| 3,849,810 | 11/1974 | Degen | 5/341 |

FOREIGN PATENTS OR APPLICATIONS

| | | | |
|---|---|---|---|
| 453,123 | 5/1913 | France | 5/357 |
| 263,220 | 6/1947 | Switzerland | 5/357 |

OTHER PUBLICATIONS

Gardiner, "Flexagon", Dec. 1956, Scientific American, p. 156 ff.

Oakly, et al., "American Mathematical Monthly", Mar., 1957.

*Mysterious Flexagons*, Jones, Pub. 1956, Crown Pub.

*Primary Examiner*—Paul R. Gilliam

*Assistant Examiner*—Victor N. Sakran

[57] ABSTRACT

A manipulative pillow arrangement is formed by a closed chain of folded and interconnected padded pillow sections. Relative movement of the sections produces a change in the relationship between the patterns of the fabric covering the various sections thus providing a flexible and amusing decorative effect.

1 Claim, 9 Drawing Figures

PILLOW STRUCTURE

FIELD OF THE INVENTION

This invention relates to pillows and the like used primarily for decorative purposes and more particularly to such pillows which have a number of padded sections.

BACKGROUND OF THE INVENTION

Pillows having a number of stuffed, padded, or otherwise filled sections are well known in the art. Typically, the pillows are fabricated to allow movement of the various sections with respect to one another in order to provide added or adjustable support for the human body in different positions. Decorative pillows, on the other hand, usually comprise only a single stuffed section, exhibiting a singular and unchanging decorative effect.

BRIEF DESCRIPTION OF THE INVENTION

The present invention is directed at a decorative (pad or) pillow arrangement comprising a number of like sections interconnected into a chain. The sections are folded into groups in a manner to define an overall geometry for the pillow. Moreover, the sections are transferrable from group to group by manipulating the various sections. When the sections include decorative patterns which are corrolated with respect to one another, the manipulation of the sections changes the patterns and thus the decorative effect while maintaining the overall geometry of the pillow unchanged. The manipulation also exposes clean pillow surfaces.

DETAILED DESCRIPTION

Figure 1A:
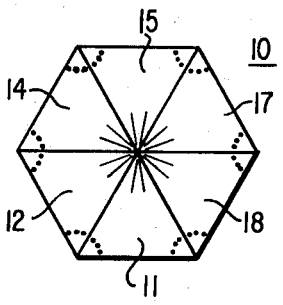
FIGS. 1A and 1B are top views of a hexagon pillow showing alternative designs when manipulated into two different stable conditions.
Figure 1B:
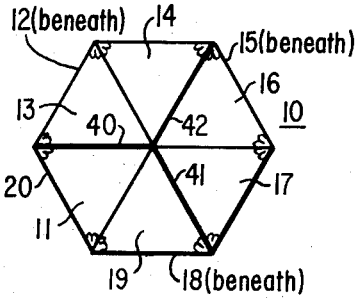

FIGS. 1A and 1B show a pillow arrangement 10 in accordance with this invention with different patterns as shown. The pillow has an hexagonal overall geometry and comprises a plurality of triangular padded sections shown interconnected in a line in FIG. 2. The line comprises sections 11 through 19 in sequence shown separated into equalateral triangles by dashed lines.

The hexagon pillow, of FIGS. 1A and 1B, is formed by folding the line of triangular sections into three groups. One group, designated 20 in FIG. 2, comprises triangular sections 11, 12, and 13, and is shown separated from the remaining sections by imaginary broken line A-B. A second group 21 comprises triangular sections 14, 15, and 16 and lies between imaginary broken lines A-B and C-D in FIG. 2. A third group, comprising triangular sections 17, 18, and 19 is designated 22 in FIG. 2.

Figure 2:
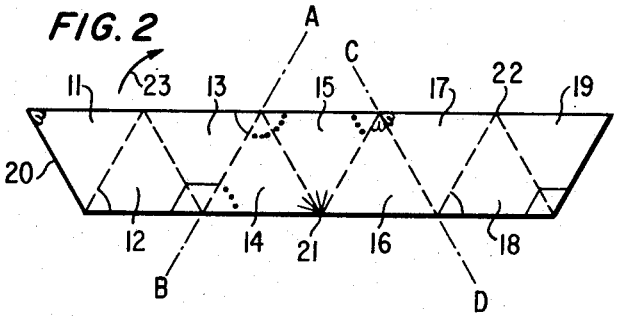
Figure 4:
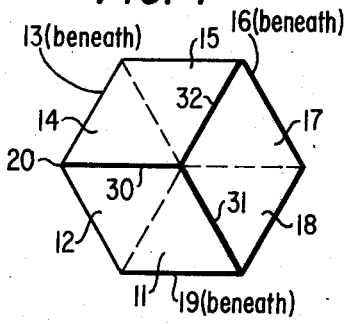
Figure 3:
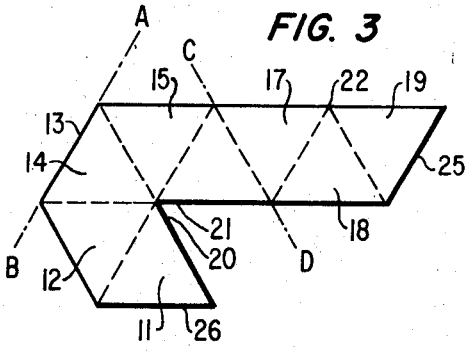

FIG. 3 shows group 20 folded backward from the rest of the line of sections at broken line A-B as indicated by arrow 23 in FIG. 2. FIG. 4 shows group 22 folded forward from its position as viewed in FIG. 3, section 19 lying beneath section 11 as shown in FIG. 4. Edge 25 of section 19 is attached, typically by sewing, to edge 26 of section 11 to form an endless chain of sections in an overall hexagonal shape as shown.

A pattern on the faces of section 11, 18, 17, 15, 14, and 12 as shown in sequence moving counterclockwise in FIG. 1A is changed into the pattern shown in FIG. 1B by raising (towards the viewer) the center of the hexagon shown in FIG. 4 and by manipulating the various sections with respect to one another. FIG. 4 shows radial lines 30, 31, and 32 demarkating double section thicknesses. That is to say, at each of those radial lines, a hand may be inserted between two sections in the hexagon. For example, at line 31 in FIG. 4, a hand may be inserted between section 11 and section 19. When the center of the hexagon is raised (flexed) and lines 31, 32, and 33 are depressed (i.e. pinched together), the hexagon appears in a star shape, opening in the center to reveal partially the previously hidden faces of the sections shown exposed in FIG. 1B. When the star of FIG. 5 is opened into a hexagon, the hexagon once again will show double sections which open similarly along lines 40, 41, and 42 in FIG. 1B.

Figure 5:
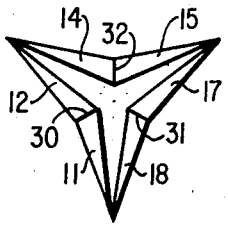
FIGS. 2, 3, 4, 5, and 6 show schematically, alternative views of interconnected padded sections of a pillow arrangement in accordance with this invention folded into groups of sections and interconnected to form a hexagonal shape of FIGS. 1A and 1B.

The hexagon may be flexed, as shown in FIG. 5, repeatedly, exposing three new sections and covering three others in each instance. The precession of the exposed sections can be understood most easily by a comparison of FIGS. 1A and 1B. Note that in FIG. 1A, corresponding to FIG. 4, sections 13, 16 and 19 are hidden. In FIG. 1B on the other hand, sections 12, 15, and 18 are hidden. Each time the hexagon is flexed, the next lower-numbered sections are hidden. Of course, in each instance the patterns on the various sections mate in a different manner to produce a different design, two of these designs being shown in FIGS. 1A and 1B.

As successively lower-numbered sections are hidden during successive manipulation of the hexagon, those lower-numbered sections precess through the various groups of sections defined above. It is convenient to adapt the convention that the groups 20, 21, and 22 remain fixed in space as shown in FIGS. 3 and 4. Originally, sections 11, 12, and 13 (under 14) of FIG. 4 are included in group 20. With one manipulation of the hexagon, on the other hand, sections 19, 11 and 12 of FIG. 1B are included in group 20. It is clear that section 19 originally in group 22 has been moved to group 20. Thus successive manipulation of the pillow results in a precession of sections through groups of sections which bear with respect to one another a stable relationship which defines the overall geometry of the pillow.

Figure 6:
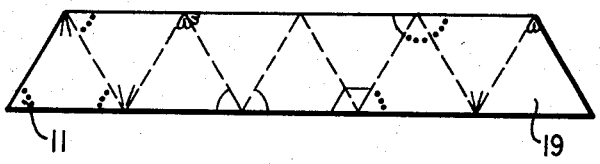

The design portions shown on the front faces of the triangular sections in FIG. 4 and on the rear faces of those sections as shown in FIG. 6 produce the patterns shown in FIGS. 1A and 1B when the hexagon is manipulated as described. Further manipulations produce different relationships between the design portions as different sections are moved into adjacent positions.

To permit sections to be manipulated into a variety of stable positions without varying the overall geometry of the pillow, the various sections must have like dimensions to permit the exchange of one section for another. That is to say, all the sides of the sections have to be equal for such an exchange to be permitted. The hexagon pillow shown comprises nine equalateral triangular sections to permit the exchange. But other section geometries are possible for different overall shapes.

Figure 7:
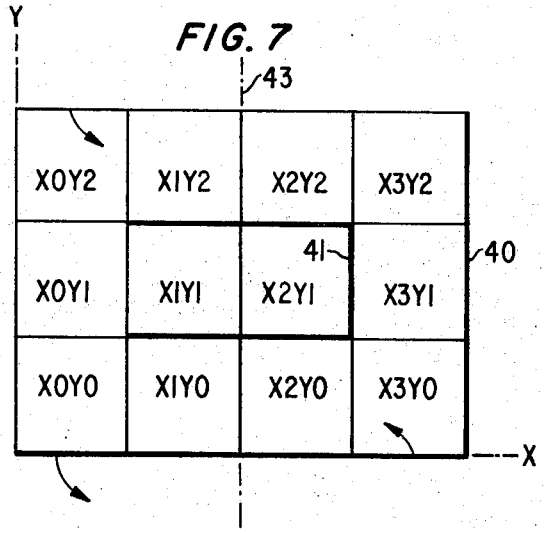
FIGS. 7 and 8 show interconnected sections of alternative pillow arrangements in accordance with this invention.
Figure 8:
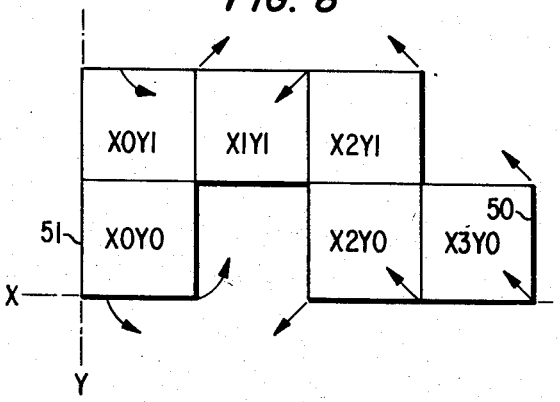

FIGS. 7 and 8 show alternative designs based on a square section geometry rather than a triangular geometry. These figures show pillow geometries which illustrate that the dimensions of the sections need be alike only in the direction along which the section exchange takes place. For example, in FIG. 7 the squares may be thought of as squares of a graph. In this context, we can designate the squares in terms of columns of *x* and rows of *y*, *x* increasing from left to right and *y* increasing from bottom to top. The bottom row as viewed in the figure thus comprises sections designated Xo Yo, Xl Yo, X2 Yo, X3 Yo.

The overall geometry of the pillow formed from padded squares in the geometry of FIG. 7 is that of a rectangle two columns wide and three rows high, as viewed in the figure, once the various sections are interconnected to permit manipulation. Manipulation occurs by exchanging one column of sections for another as will become clear. Since only a column exchange is permitted, only row (X) dimensions (i.e., Xo =X, =X1, =X2, =X3,) need be the same. The Y dimensions may differ.

Interconnecton of the sections for manipulation of the pillow arrangement of FIG. 7 is achieved by folding the columns and by joining the end columns. First, section X1 Y1 and section X2 Y1 are separated from sections X1 Y2, X2 Y2, and X1 Yo and X2 Yo. Sections X1 Y1 and Y2 Y1 remain attached to sections Yo Y1. Sections X1 Y1 and X2 Y1 are folded backward against and then around section Xo Y1 section X2 Y1 ultimately lying on top of section Xo Y1. Then column X3 is folded backwards against column X2 as indicated by the arrows in the figure. Edge 40 of section X3 Y1 is then attached to edge 41 of section X2 Y1 thus forming the overall two column geometry. When the two columns are folded backwards along broken (imaginary) line 43 in FIG. 7, the columns separate and new columns are exchanged for the original set.

The designation of sections as shown in FIG. 7 is for ease of description in terms of a graphic representation. For consistency with the usage of the terms "section" and "groups" of sections in the embodiment of FIGS. 1 through 6 a column in FIG. 7 may be thought of as a section. It may be seen more easily that the (columns) sections are interconnected into a chain and a group includes only one section. It is helpful to remember that the term "group" designates an imaginary and stationary area into which the sections precess by manipulation. In this context, the individual portions (i.e., Xo Y2, Xo Y1, and Xo Y2) of a column (i.e. Col Xo) may be thought of as subsections. As was the case with the pillow sections of FIG. 2 and FIG. 6, both front and rear faces of the subsections shown in FIG. 7 may have patterns (not shown) which mate with one another to form different designs when the pillow is manipulated as described.

FIG. 8 shows an embodiment which includes two rows and four columns of subsections which fold and interconnect into an overall square geometry. Once again, a graphic representation is employed for convenience. In this embodiment, section X3 Yo folds backward at the intersection with section X2 Yo. Then the left edges of columns Xo and X2 (as viewed) are moved forward (like an accordian) as indicated by the arrows in the Figure. The right edge 50 of section X3 Yo is interconnected with the left edge 51 of section Xo Yo. The patterns on the exposed front faces of the resulting square geometry comprises pattern portions from sections Xo Y1, and X1 Y1 along with the pattern portions from sections X2 Yo and X3 Yo. The rear face of the square comprises portions from sections X2 Yo and X2 Y1, along with portions from the rear faces of sections Xo Y1 and Xo Yo. The embodiment of FIG. 8 may be appreciated to be similar to that of FIG. 7 having columns each with two square subsections and one column (i.e., section) to a group. This embodiment flexes along a vertical axis as viewed in the figure.

On the other hand, a square geometry may be provided which flexes along both vertical and horizontal axes. Such a square geometry is made, for example, by starting with a square with four square sections to a side. The center four squares are omitted from the initial sixteen squares to form a square annulus. One side of the annulus is separated between the middle two squares and the sections of each side are folded accordian style into a stack under the corner sections prior to interconnecting the cut edges. One section adjacent the cut is omitted.

What has been described is considered merely illustrative of the principles of this invention. Therefore, various embodiments can be devised by those skilled in the art in accordance with those principles within the spirit and scope of this invention as encompassed by the following claims. Although individual geometries can be generated on a cut and try basis, the underlying mathematical principles for those geometries are discussed in an article by Martin Gardiner entitled "Flexagon" starting at page 162 of the December 1956 issue of Scientific American and an article by Oakly and Wisner in the March 1957 issue of American Mathematical Monthly. Also, a book entitled *Mysterious Flexagons* by Madelaine Jones, published in 1966 by Crown Publishers further elaborates on these principles. It is considered a principal feature of this invention to adapt these mathematical principles to a practical use by employing padded sections for manipulation, typically with one fewer sections than would otherwise be used with a paper design.

What is claimed is:

1. A manipulative arrangement comprising a plurality of stuffed triangular sections interconnected in a chain including a first and a last section wherein said chain is folded to form an overall hexagon shape, said chain being foldable into a plurality of groups such that said first and last sections are in close proximity to form an overall geometrical shape, said first and last section being attached to one another in a manner to permit the manipulation of some of said sections from one to another of said groups and to preserve said shape wherein said sections are manipulated about an axis and said sections have sides of equal lengths transverse to said axis.

* * * * *